US005433596A

United States Patent [19]

Döbbeling et al.

[11] Patent Number: 5,433,596

[45] Date of Patent: Jul. 18, 1995

[54] PREMIXING BURNER

[75] Inventors: Klaus Döbbeling, Nussbaumen; Adnan Eroglu, Untersiggenthal; Thomas Sattelmayer, Mandach, all of Switzerland

[73] Assignee: ABB Management AG, Baden, Switzerland

[21] Appl. No.: 215,252

[22] Filed: Mar. 21, 1994

[30] Foreign Application Priority Data

Apr. 8, 1993 [CH] Switzerland ..... 1082/93

[51] Int. Cl.[6] ..... F23D 14/46

[52] U.S. Cl. ..... 431/350; 431/351; 431/182; 431/185

[58] Field of Search ..... 431/182, 185, 350, 351

[56] References Cited

U.S. PATENT DOCUMENTS 5,340,306 8/1994 Keller et al. ..... 431/351

FOREIGN PATENT DOCUMENTS

0321809B1 5/1991 European Pat. Off. .

0520163A2 12/1992 European Pat. Off. .

*Primary Examiner*—Carroll B. Dority

*Attorney, Agent, or Firm*—Burns, Doane, Swecker & Mathis

[57] ABSTRACT

A premixing burner on the double-cone principle consists essentially of two hollow conical partial bodies (111, 112) which are interleaved in the flow direction and whose respective center lines (113, 114) are offset relative to one another. The adjacent walls of the two partial bodies form tangential gaps (20) in their longitudinal extent for the combustion air. Gas inlet openings (117) distributed in the longitudinal direction are provided in the walls of the two partial bodies. The air is guided into the tangential gaps (20) via vortex generators (9) of which a plurality are arranged adjacent to one another. The fuel is introduced into the gaps (20) in the immediate region of the vortex generators (9).

Using the novel static mixer which the three-dimensional vortex generators represent, longitudinal vortices without recirculation region can be generated in the inlet gap through which flow occurs. It is therefore possible to achieve extraordinarily short mixing distances at the inlet to the burner with a small pressure loss at the same time.

6 Claims, 3 Drawing Sheets

PREMIXING BURNER

BACKGROUND OF THE INVENTION

1. Field of the Invention

The invention relates to premixing burners on the double-cone principle with, essentially, two hollow conical partial bodies which are interleaved in the flow direction and whose respective center lines are offset relative to one another, the adjacent walls of the two partial bodies forming tangential gaps in their longitudinal extent for the combustion air and gas inlet openings distributed in the longitudinal direction being provided in the region of the tangential gaps in the walls of the two partial bodies.

2. Discussion of Background

Such double-cone burners are known, for example, from EP-B1-0 321 809 and are described later with respect to FIG. 1 and 2. The fuel, natural gas in that case, is injected in the inlet gaps into the combustion air flowing from the compressor. This is done by means of a row of injection nozzles which are usually evenly distributed over the complete gap.

Thorough mixing of the fuel with the air is necessary in order to achieve reliable ignition of the mixture in the downstream combustion chamber and to achieve sufficient burn-out. Good mixing also contributes to avoiding so-called "hot spots" in the combustion chamber which, inter alia, lead to the formation of the undesirable $NO_x$.

The abovementioned injection of the fuel by using classical means such as cross-jet mixers is difficult because the fuel itself has insufficient momentum to achieve the necessary large-scale distribution and fine-scale mixing.

SUMMARY OF THE INVENTION

Accordingly, one object of the invention is to equip a double-cone burner of the type mentioned at the beginning with a novel appliance by means of which longitudinal vortices without a recirculation zone can be generated in the inlet gap through which flow occurs.

According to the invention, this is achieved by guiding the air into the tangential gaps via vortex generators, of which a plurality are arranged adjacent to one another and preferably without intermediate spaces over the width or the periphery of the gap through which flow occurs, the height of the vortex generators being at least 50% of the height of the gap through which flow occurs, and by introducing the fuel into the gaps in the immediate region of the vortex generators.

Using the novel static mixer which the three-dimensional vortex generators represent, it is possible to achieve extraordinarily short mixing distances at the inlet to the burner with a small pressure loss at the same time. Rough mixing of the two flows has already taken place after one full revolution of the vortex whereas fine mixing due to turbulent flow is present after a distance which corresponds to a few gap heights.

This type of mixing is particularly suitable for mixing fuel with a relatively small upstream pressure into the combustion air with a large amount of dilution. A low fuel upstream pressure is of particular advantage when medium and low calorific value fuel gases are used. The energy necessary for mixing is then taken, to a substantial extent, from the flow energy of the fluid with the higher volume flow, namely the combustion air.

A vortex generator is one,

—wherein there are three surfaces around which flow can take place freely, which surfaces extend in the flow direction, one of them forming the top surface and the two others forming the side surfaces, —wherein the side surfaces abut the same gap wall and enclose a V-angle $\alpha$ between them, —wherein a top surface edge extending transversely to the gap through which flow occurs is in contact with the same gap wall as the side walls, —and wherein the longitudinally directed edges of the top surface, which abut the longitudinally directed edges of the side surfaces protruding into the flow gap, extend at an angle of incidence $\theta$ to the gap wall.

The advantage of such an element may be seen in its particular simplicity in every respect. From the point of view of manufacture, the element consisting of three walls around which flow occurs is completely unproblematic. The top surface can be joined to the two side surfaces in various ways. The fixing of the element onto flat or curved gap walls can also take place by means of simple welds in the case of weldable materials. The vortex generators, together with the adjacent walls, can also of course be cast. From the point of view of fluid mechanics, the element has a very low pressure loss when flow takes place around it and it generates vortices without a dead water region. Finally, the element can be cooled in many different ways and with various means because of its generally hollow internal space.

Given an even incident flow of the combustion air into the inlet gaps, it is appropriate to select the ratio of the height h of the connecting edge of the two side surfaces to the gap height H in such a way that the vortex generated fills the complete gap height or the complete height of the gap part-associated with the vortex generator immediately downstream of the vortex generator.

Because a plurality of vortex generators are arranged adjacent to one another without intermediate spaces over the width of the inlet gap through which flow occurs, the complete gap cross section is already fully subject to the action of the vortices shortly behind the vortex generators.

In the case of a varying velocity field in the inlet gaps, it is useful to provide different heights for the vortex generators, which are arranged adjacent to one another, in such a way that the absolute pressure loss along the inlet gap remains constant, It is useful for the two side surfaces which include the V-angle $\alpha$ to be arranged symmetrically about an axis of symmetry. Vortices with the same swirl strength are generated by this means.

Further advantages of the invention, in particular in association with the arrangement of the vortex generators and the introduction of the fuel, are given in the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
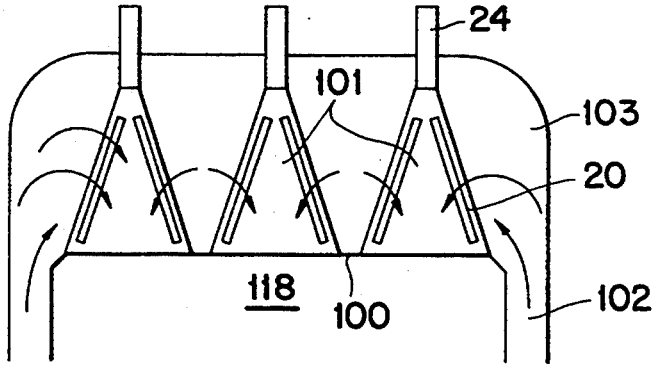
FIG. 1 shows a partial longitudinal section of a combustion chamber.

Referring now to the drawings, wherein like reference numerals designate identical or corresponding parts throughout the several views, where only the elements essential for understanding the invention are shown (elements inessential to the invention such as casing, fastenings, conduit through-leads, preparation of the fuel, control devices and the like are omitted) and the flow direction of the working media is indicated by arrows, in FIG. 1 a plurality of premixing burners 101 are arranged in the combustion chamber wall 100 in the dome-shaped end of the combustion chamber. Gas is advantageously used as the fuel. The combustion air reaches the inside 103 of the casing from an annular air inlet 102 and flows from the inside 103 of the casing in the direction of the arrows into the burners 101.

Figure 2A:
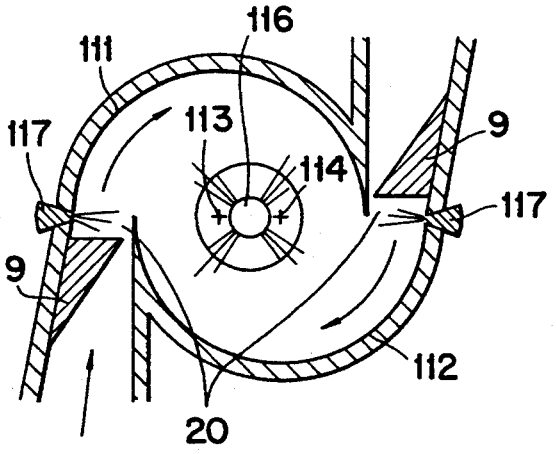
FIG. 2A shows a cross section through a premixing burner in the region of the burner outlet.
Figure 2B:
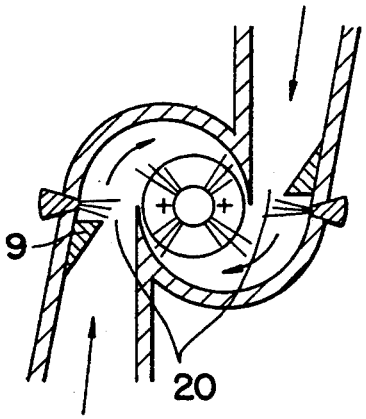
FIG. 2B shows a cross section through a premixing burner in the region of the apex of the cones.

The diagrammatically represented premixing burner 101 of FIGS. 1 and 2A–B is a so-called double-cone burner such as is known, for example, from EP-B1-0 321 809. It consists essentially of two hollow conical partial bodies 111, 112 which are interleaved in the flow direction. The respective center lines 113, 114 of the two partial bodies are offset relative to one another. In their longitudinal extent, the adjacent walls of the two partial bodies form tangential gaps 20 for the combustion air which, in this way, reaches the inside of the burner. A first fuel nozzle 116 for liquid fuel is arranged there. The fuel is sprayed with an acute angle into the hollow cone. The resulting conical fuel profile is enclosed by the tangentially entering combustion air. The concentration of the fuel is continuously reduced in the axial direction because of the mixing with the combustion air. In the case considered as an example, the burner is also operated with gaseous fuel. For this purpose, gas inlet openings 117 distributed in the longitudinal direction are provided, in the region of the tangential gaps 20, in the walls of the two partial bodies. In gas operation, therefore, the mixture formation with the combustion air has already commenced in the zone of the inlet gaps 20. It is obvious that mixed operation with both types of fuel is also possible in this way.

At the burner outlet 118, a fuel concentration occurs which is as homogeneous as possible over the annular cross-section to which the mixture is admitted. A defined cap-shaped reverse flow zone occurs at the burner outlet and ignition takes place at the apex of this zone.

Double-cone burners are known to this extent from EP-B1-0 321 809, which was mentioned at the beginning. The mode of operation of the vortex generator essential to the invention is described first before the installation of the novel mixing appliance in the burner is considered.

Figure 3:
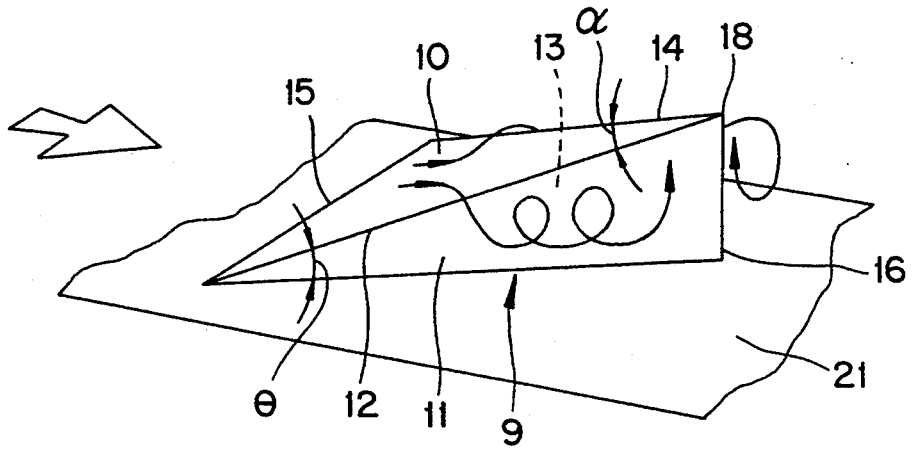
FIG. 3 shows a perspective representation of a vortex generator.
Figure 4:
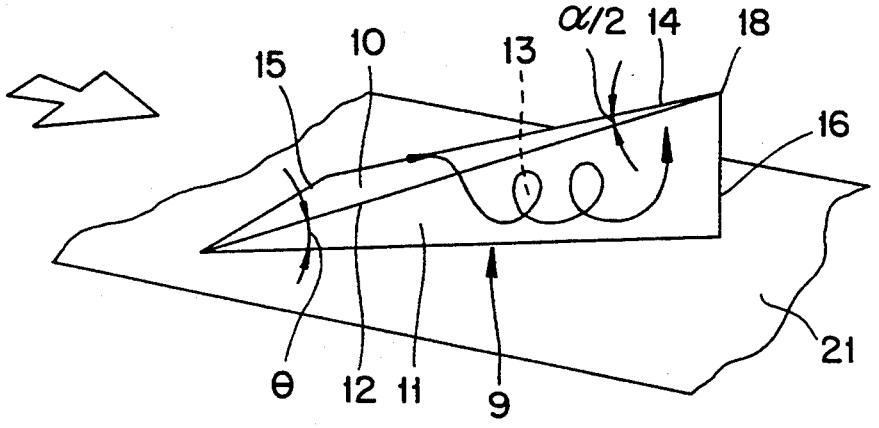
FIG. 4 shows an embodiment variant of the vortex generator.
Figure 5:
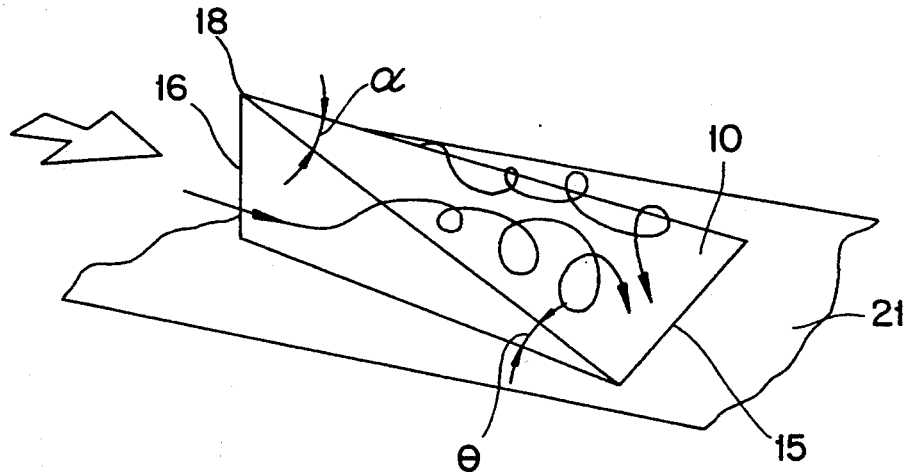
FIG. 5 shows an arrangement variant of the vortex generator of FIG. 3.

The actual inlet gap, through which flows a main flow symbolized by the large arrow, is not shown in FIGS. 3–5. As shown in these figures, a vortex generator 9 consists essentially of three triangular surfaces around which flow takes place freely. These surfaces are a top surface 10 and two side surfaces 11 and 13. In their longitudinal direction, these surfaces extend at certain angles in the flow direction.

In all the examples shown, the two side surfaces 11 and 13 are at right angles to the gap wall 21 but it should be noted that this is not imperative. The side walls, which consist of right-angle triangles, are fixed with their longitudinal sides on this gap wall 21, preferably in a gastight manner. They are oriented in such a way that they form a joint on their narrow sides and include a V-angle $\alpha$. The joint is designed as a sharp connecting edge 16 and is also at right angles to the gap wall 21 which the side surfaces abut. The two side surfaces 11, 13 enclosing the V-angle $\alpha$ are symmetrical in shape, size and orientation and are arranged on both sides of an axis of symmetry 17 (FIG. 6*b*, 7*b*). This axis of symmetry 17 has the same direction as the gap axis.

An edge 15 of the top surface 10 has a very sharp configuration and extends transversely to the inlet gap through which flow occurs. This edge is in contact with the same wall 21 as the side walls 11, 13. Its longitudinally directed edges 12, 14 abut the longitudinally directed edges of the side surfaces protruding into the flow gap. The top surface extends at an angle of incidence $\theta$ to the gap wall 21. Its longitudinal edges 12, 14 form, together with the connecting edge 16, a point 18.

The vortex generator can also, of course, be provided with a bottom surface by means of which it is fastened to the gap wall 21 in a suitable manner. Such a bottom surface, however, has no relationship to the mode of operation of the element.

In FIG. 3, the connecting edge 16 of the two side surfaces 11, 13 forms the downstream edge of the vortex generator. The edge 15, of the top surface 10, extending transversely to the inlet gap through which flow occurs is therefore the edge which the gap flow meets first.

The mode of operation of the vortex generator 9 is as follows. When flow occurs around the edges 12 and 14, the main flow is converted into a pair of opposing vortices. The vortex axes are located in the axis of the main flow. There is a neutral swirl flow pattern present in which the direction of rotation of the two vortices is rising in the region of the connecting edge. The swirl number and the location of vortex breakdown, where the latter is desirable at all, are determined by appropriate selection of the angle of incidence $\theta$ and the V-angle $\alpha$. With increasing angles, the vortex strength and the swirl number are increased and the location of the vortex breakdown moves upstream into the region of the vortex generator itself. These two angles $\theta$ and $\alpha$ are specified, depending on the application, by design requirements and by the process itself. It is then only necessary to match the height h of the connecting edge 16 (FIG. 6*a*).

Figure 6A:
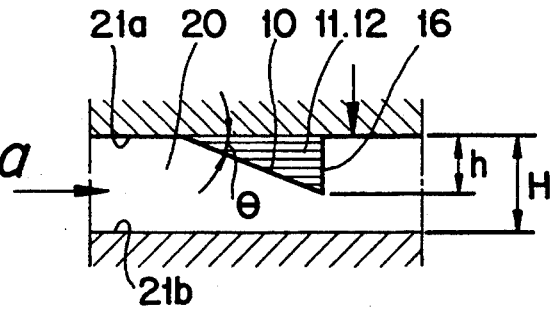
FIGS. 6*a–c* show the arrangement in groups of vortex generators in an inlet gap, in longitudinal section, in plan and in a rear view.
Figure 6B:
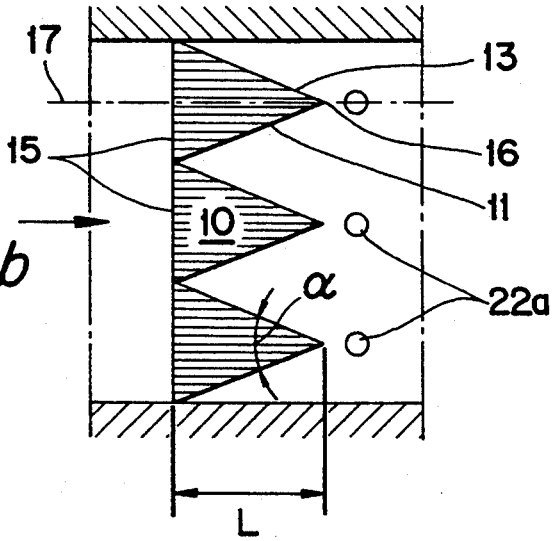

In FIGS. 6*a* and 6*b*, in which the inlet gap through which flow occurs is indicated by 20, it may be recognized that the vortex generator can have a different height relative to the gap height H. In general, the height h of the connecting edge 16 will be matched to the gap height H in such a way that the vortex generated has already reached such a size directly downstream of the vortex generator that the full gap height H is filled. A further criterion which can have an influence on the ratio h/H to be selected is the pressure drop which occurs when flow takes place around the vortex generator. It is obvious that as the ratio of h/H increases, the pressure loss coefficient will also increase.

On the basis of a vortex generator 9 as shown in FIG. 3, FIG. 4 shows a so-called "half vortex generator" 9*a* in which only one of the side surfaces is provided with a V-angle $\alpha/2$. The other side surface is straight and directed in the flow direction. In contrast to the symmetrical vortex generator 9, there is only one vortex in this case and it is generated on the angled side. In consequence, the field downstream of the vortex generator 9*a* is not vortex-neutral and a swirl is imposed on the flow, provided the vortex generator 9*a* is isolated.

In contrast to FIG. 3, the sharp connecting edge 16 of the vortex generator 9 in FIG. 5 is the position which the gap flow meets first. The element is rotated by 180°. As may be seen from the representation, the two opposing vortices have changed their direction of rotation.

Figure 6C:
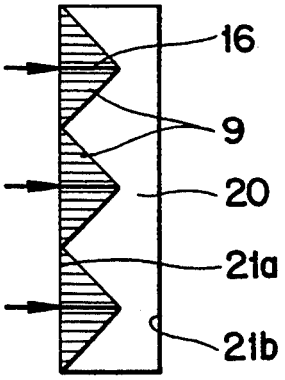

FIGS. 6A–C shows how a plurality of vortex generators 9, in this case three, are arranged adjacent to one another, without intermediate spaces, over the width of the inlet gap 20 through which flow occurs. In this case, the inlet gap 20 has a rectangular shape - but this is not essential to the invention.

Figure 7A:
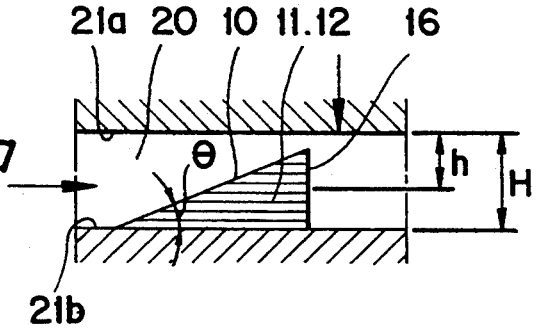
FIGS. 7*a–c* show an embodiment variant of an arrangement in groups of vortex generators in the same representation as FIG. 3 with a variant of the fuel guidance.
Figure 7B:
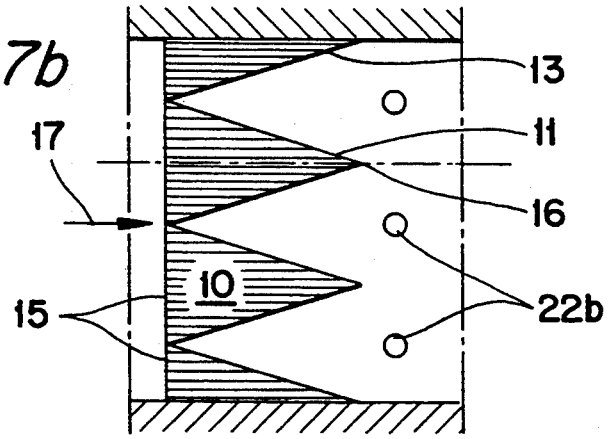
Figure 7C:
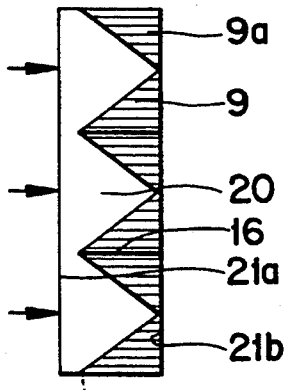

An embodiment variant with two full vortex generators (9) and, on both sides of them, two half vortex generators (9*a*) is shown in FIGS. 7A–C. For the same gap height H and the same angle of incidence $\theta$ of the top surface 10 as in FIG. 6, the elements differ, in particular, because of their larger height h. For the same angle of incidence, this necessarily leads to an increased length L of the element and in consequence because the pitch is the same—it also leads to a smaller V-angle $\alpha$. Compared with FIG. 6, the vortices generated will have less swirl but will completely fill the gap cross section within a shorter interval. If vortex breakdown is intended in both cases in order to stabilize the flow, for example, this will take place later in the case of the vortex generator of FIGS. 7A–C than it does with that of FIG. 6.

The ducts shown in FIGS. 6A–C and 7A–C represent rectangular low pressure air ducts. It should again be noted that the shape of the inlet gap through which flow occurs is not essential to the mode of operation of the invention. Two flows are mixed with one another with the aid of the vortex generators 9, 9*a*. The main flow in the form of combustion air attacks the transversely directed inlet edges 15 in the direction of the arrow. The secondary flow in the form of fuel has a substantially smaller mass flow than the main flow and is introduced into the main flow in the immediate region of the vortex generators.

As shown in FIG. 6B, this injection takes place by means of individual holes 22*a* which are made in the wall 21*a*. The wall 21*a* is the wall on which the vortex generators are arranged. The holes 22*a* are located on the line of symmetry 17 downstream behind the connecting edge 16 of each vortex generator. In this configuration, the fuel is put into the large-scale vortices which already exist.

FIG. 7B shows an embodiment variant of an inlet gap in which the fuel is likewise injected via wall holes 22*b*. These are located downstream of the vortex generators in the wall 21*b* on which the vortex generators are not arranged, i.e. on the wall opposite to the wall 21*a*. The wall holes 22*b* are respectively made in the center between the connecting edges 16 of two adjacent vortex generators, as may be seen from FIG. 4. In this way, the fuel enters the vortices in the same way as in the embodiment of FIG. 6B. There is, however, the difference that it is no longer mixed into the vortex of a vortex pair generated by the same vortex generator but into one vortex each from two adjacent vortex generators. Because the adjacent vortex generators are arranged without intermediate space and generate vortex pairs with the same direction of rotation, the injections in accordance with FIGS. 6B and 7B have the same effect.

Figure 8:
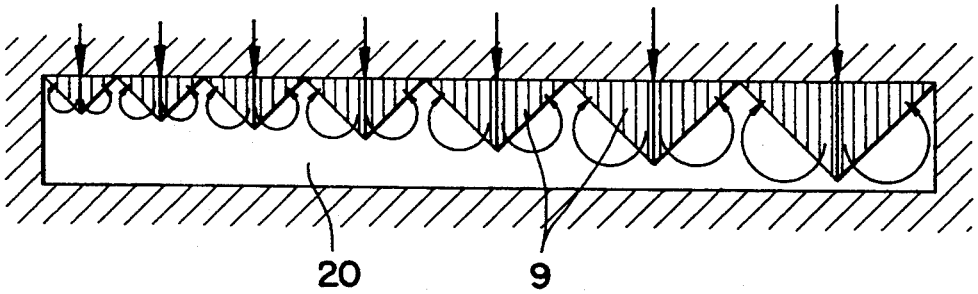
FIG. 8 shows a front view of an inlet gap with vortex generators installed.

In the case of the inlet gap of FIG. 8, it is assumed that a velocity field is present which varies in magnitude. The velocity at the apex of the cone at the head of the burner is approximately 1.5 to 2 times as high as that at the end of the gap near the burner outlet. The dynamic pressure in the gap therefore varies by a factor of approximately 3. In order to avoid disturbing the flow inside the burner, however, the absolute pressure loss along the inlet gap should be constant. This is achieved by the different heights of the vortex generators shown in FIG. 8. The different heights also, of course, cause a different pressure drop. The result is that the pressure loss of the burner is only increased by the pressure loss of the vortex generators. Overall, this is less than 10% of the burner pressure loss.

It is evident that it is necessary to dispense with the publication of absolute values at this point because such values are, in any event, inconclusive because they depend on parameters which are all too numerous. It is simply stated as an example that tests on a certain type of vortex generator have shown that for a given velocity distribution along the rectangular gap—a height of the vortex generators of approximately $\frac{1}{4}$ of the gap height at the head of the burner gives approximately the same pressure loss as vortex generators at the end of the burner which fill approximately $\frac{3}{4}$ of the gap height. In the region of the apex of the cone, therefore, the vortex generators have a height which does not correspond to the recommended minimum height of 50% of the gap height. Compensation for the non-optimum mixing achieved there, however, is provided further downstream on the relatively long mixing length to the mouth of the burner. Overall, perfect premixing can be expected for an unchanged burner flow field.

In FIG. 8, all the vortex generators have the same V-angle and the same angle of incidence which, in accordance with FIGS. 2A and 2B, leads to different lengths of the vortex generators for a given height. If it is desired to carry out the fuel supply in the plane of the connecting edges in accordance with the rules given in FIGS. 6A–C, this obviously also leads to an unequal distance apart and, consequently, to an unequal diameter of the individual holes.

Figure 9:
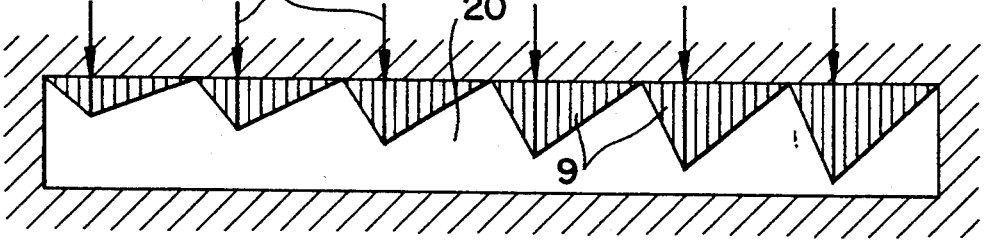
FIG. 9 shows an arrangement variant of the vortex generators in the inlet gap.

In the case of the inlet gap of FIG. 9, it is assumed that a velocity field is present which varies in magnitude and direction. In addition to matching the pressure drop, it is necessary to ensure that the angle of the entering combustion air is not changed in this case. The axis of symmetry of the vortex generator correspondingly extends in the flow direction in this case, i.e. at a certain angle to the longitudinal axis of the gap. In this example, the vortex generators have the same V-angle but different angles of incidence. The length of all the elements is therefore the same. The holes for the fuel injection are equidistant.

The fuel injected is entrained by the vortices and mixed with the air. It follows the helical course of the vortices and is evenly and finely distributed inside the burner downstream of the vortices. The danger of jets impinging on the opposite wall and forming so-called "hot spots"—which occurred in the previously usual radial injection of fuel into an unswirled flow—is reduced by this means.

Because the main mixing process takes place in the vortices and is to a large extent insensitive to the injection momentum of the fuel, the fuel injection can be kept flexible and matched to other boundary conditions. As an example, the same injection momentum can be retained over the whole of the load range. Because the mixing is determined by the geometry of the vortex generators and not by the machine load—the gas turbine load in the present example—the burner configured in this way operates in an optimum manner even under part-load conditions.

The invention is not, of course, limited to the examples described and shown. With respect to the arrangement of the vortex generators in the composite, many combinations are possible without leaving the framework of the invention. The introduction of secondary flow into the main flow can also be undertaken in a variety of ways.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A premixing burner comprising:

two hollow conical partial bodies disposed to form a conical burner interior having a flow direction respective longitudinal center lines of the bodies being offset relative to one another to form longitudinally extending gaps for a tangential flow of combustion air into the interior, gas inlet openings being distributed in the longitudinal direction in the region of the tangential gaps in walls of the two partial bodies; and a plurality of vortex generators disposed on the walls of the partial bodies in the gaps and arranged adjacent to one another without intermediate spaces over the width or the periphery of the gap through which flow occurs, each vortex generator having three surfaces around which flow takes place freely, the surfaces extending in the flow direction, and forming a top surface and two side surfaces, the side surfaces each abutting a wall and enclosing a V-angle between them, a top surface edge extending transversely to the inlet gap through which flow occurs being in contact with the same gap wall as the side walls, and longitudinally directed edges of the top surface which abut longitudinally directed edges of the side surfaces protruding into the flow gap extending into the gap at an angle to the gap wall, a height of the vortex generators being at least 50% of a height of the gap through which flow occurs, wherein fuel is introduced into the gaps in the immediate region of the vortex generators.

2. The premixing burner as claimed in claim 1, wherein the ratio of the height of the vortex generator to the gap height is selected so that the vortex generated fills the complete gap height immediately downstream of the vortex generator.

3. The premixing burner as claimed in claim 1, wherein the two vortex generator side surfaces enclosing the V-angle are arranged symmetrically about an axis of symmetry.

4. The premixing burner as claimed in claim 1, wherein the two side surfaces enclosing the V-angle include between them a connecting edge which, together with the longitudinally directed edges of the top surface, forms a point, and wherein the connecting edge advantageously extends at right angles to the gap wall which the side surfaces abut.

5. The premixing burner as claimed in claim 4, wherein at least one of the connecting edge and the longitudinally directed edges of the top surface are configured to be at least approximately sharp.

6. The premixing burner as claimed in claim 1, wherein the vortex generators arranged adjacent to one another in the gap have different heights.

* * * * *